US006852221B2

(12) United States Patent
Smolley

(10) Patent No.: US 6,852,221 B2
(45) Date of Patent: Feb. 8, 2005

(54) LINT TRAP

(76) Inventor: John M. Smolley, 8654 Wedgewood La., Maple Grove, MN (US) 55369

( * ) Notice: Subject to any disclaimer, the term of this patent is extended or adjusted under 35 U.S.C. 154(b) by 0 days.

(21) Appl. No.: 10/838,700

(22) Filed: May 4, 2004

(65) Prior Publication Data

US 2005/0000920 A1 Jan. 6, 2005

Related U.S. Application Data

(60) Provisional application No. 60/467,887, filed on May 6, 2003.

(51) Int. Cl.[7] ..... B01D 35/027

(52) U.S. Cl. ..... 210/238; 210/248; 210/249; 210/455; 210/470; 210/474; 210/498; 68/18

(58) Field of Search ..... 210/232, 238, 210/241, 248, 249, 251, 348, 407, 455, 470, 473, 474, 483, 498; 68/18

(56) References Cited

U.S. PATENT DOCUMENTS

| | | | | |
|---|---|---|---|---|
| 3,275,143 A | 9/1966 | Bochan | 210/120 |
| 3,487,944 A | 1/1970 | Tucker | 210/463 |
| 3,638,799 A | 2/1972 | Serowiecki | 210/462 |
| 3,769,818 A | 11/1973 | Smith | 68/18 |
| 3,959,138 A | 5/1976 | Nichols | 210/94 |
| 3,960,733 A | 6/1976 | Van Dieren | 210/460 |
| 3,977,219 A | 8/1976 | Bochan | 68/18 |
| 3,984,330 A | 10/1976 | Nichols | 210/449 |
| 4,123,361 A | 10/1978 | Marschman | 210/232 |
| 4,523,992 A | 6/1985 | Sackett | 210/232 |
| 4,906,367 A | 3/1990 | Villagomez | 210/251 |
| 4,970,880 A | 11/1990 | Luger | 68/208 |
| 5,078,862 A | 1/1992 | Justice | 210/94 |
| 6,029,479 A | 2/2000 | Pattee | 68/18 |

*Primary Examiner*—Robert James Popovics
(74) *Attorney, Agent, or Firm*—Angenehm Law Firm, Ltd; N Paul Friederichs

(57) ABSTRACT

A lint trap, including a housing having a first side wall, a second side wall, a top wall, a bottom wall, a back wall and a front wall, and the bottom wall defining an aperture; at least one attachment mechanism joining the housing to a utility sink; a lint collection plate slot defined in the side walls; a lint collection plate, the lint collection plate being slidably received within the lint collection plate slot; and an adapter having a hose end and a trap end, the hose end being adapted to join to a hose of a washing machine and the trap end being joined relative to the aperture defined in the bottom wall and a method of use including the steps of flowing water into a flow rate control chamber of a lint trap; flowing water from the flow rate control chamber to a water release chamber; flowing water from the water release chamber through a lint collection plate; removing the lint collection plate from the lint trap; wiping lint off the lint collection plate; and reconnecting the lint collection plate to the lint trap.

17 Claims, 3 Drawing Sheets

LINT TRAP

The present invention relates to lint traps for washing machines and more particularly reusable traps for collecting, removal and disposal of lint from streams of water and claims priority from provisional patent application No. 60/467,887, filed May 6, 2003 and entitled LINT TRAP.

FIELD OF THE INVENTION

BACKGROUND OF THE INVENTION

Lint collection has long been a problem with modern clothes washing machines. Lint fibers knocked loose from the clothes float in the water in the washing machine until it is discharged out through a hose. The water and lint are then directed down a drain, perhaps in a utility sink, where the lint can clog the drain pipes causing potentially expensive repairs to be paid for by the home owner. A variety of solutions have been developed to capture the lint before it is directed down the sink drain.

For example, U.S. Pat. No. 6,029,479 (Pattee), entitled Fine particle Lint Filter discloses a filtration device with a plurality of screens with varying pore size used to collect lint in a circuitry suited to a large laundry facility. The water flow in the Pattee reference is generally in the same direction, failing to reverse the water flow and adequately slow the water to allow easy removal of the lint. Pattee design is not suited for connection to a utility sink, but rather is intended to be of a configuration suitable for recycling large volumes of water.

Some basket style collection filters include U.S. Pat. No. 3,960,733 (Van Dieren) entitled Filter Unit for Washing Machine and U.S. Pat. No. 3,638,799 (Serowiecki), entitled Clamping Unit and Drain Filter for Washing Machine Drain Lines. While these are configured to be joined to a utility sink, these references fail to teach a system suitable for adequately slowing the discharge stream sufficiently to allow good collection of lint.

U.S. Pat. No. 5,078,862 (Justice) discloses a Washer Standpipe Drain Visual Filter. Generally, a lint filter is provided that is a mesh sac. The sac fills with lint and is thereafter replaced. Justice does disclose the sac can somehow be inverted and washed out for reuse, which is fraught with its own difficulties given its construction. Typically, sacs tend to become loose prior to filling and "blow off" the hose from which the discharge water is expelled, potentially becoming a plug. Justice claims his clamping system precludes blow-outs and rather plugs the discharge stream such that the water cannot release from the washing machine.

Other sac style filters are taught by Villagomez (U.S. Pat. No. 4,906,367) entitled Lint Strainer for Washing Machine Drains; Luger (U.S. Pat. No. 4,970,880) entitled Washing Machine Lint Trap; Sackett (U.S. Pat. No. 4,523,992) entitled Filter Assembly; Marschman (U.S. Pat. No. 4,123,361) entitled Lint Filter Assembly; Nichols (U.S. Pat. No. 3,984,330), entitled Washing Machine Drain Filter; Nicholes (U.S. Pat. No. 3,959,138) entitled Washing Machine Darin Filter; Tucker (U.S. Pat. No. 3,487,944) entitled Trap for Collecting Lint Discharged from a Washing Machine; and Bochan (U.S. Pat. No. 3,275,143) entitled Filter with Cleaning Means.

A couple of obvious draw backs are apparent in reviewing sac style lint collectors. The sacs tend to completely surround and seal about the discharge hose. As lint builds in the sac, additional lint has less and less room in which to come to a rest until the sac becomes plugged. At that point, or before, the sac blows off the discharge hose under the water pressure. Alternatively, if the water pressure is not strong enough to release the sac, the water remains in the machine.

What is needed is a lint collection device that is of a basket style such that it is not subject to blow-outs, heavy clamping and blockage of the flow stream. The trap should be connectable to a utility sink, have at least one chamber for slowing the speed of the discharge stream, and have a removable filter that is easily wiped to remove the lint. Desirably, the direction of the water flow is reversed in the lint collection device to slow the stream prior to passing through the filter.

SUMMARY OF THE INVENTION

The present invention is a lint trap, which may include a housing, an attachment mechanism, a lint collection plate, and an adapter. The housing may have a first side wall, a second side wall, a top wall, a bottom wall, a back wall and a front wall, and the bottom wall defining an aperture. The attachment mechanism preferably joins the housing to a utility sink. A lint collection plate slot can be defined in the side walls and the lint collection plate may be slidably received within the lint collection plate slot. The adapter preferably has a hose end and a trap end with the hose end being adapted to join to a hose of a washing machine and the trap end being joined relative to the aperture defined in the bottom wall.

The present invention also includes a mode of operation. Lint may be removed from a washing machine discharge in the following manner. Water, carrying lint, may be flowed into a flow rate control chamber of a lint trap. The water may then be flowed from the flow rate control chamber to a water release chamber and then through a lint collection plate. The lint collection plate can be removed from the lint trap and the lint wiped off the lint collection plate. Then the lint collection plate can be reconnected to the lint trap.

Advantageously, the present invention provides a lint collection device connectable to a utility sink that slows the discharging water to a rate where the lint can be separated from the water stream.

As a further advantage, the lint from the discharge stream collects on a selectively removable and reusable plate.

As still yet another advantage, the present lint trap includes overflow ports that allow escape of water when the collection plate is full.

A further advantage is that the lint collection plate fills from the bottom up further allowing the flow rate of the water to slow before passing through the collection plate, e.g., allowing gravity to act as a separating force between the water and the lint.

These and further advantages will become apparent from reading the appended description of the preferred embodiment with consideration of the appended drawings.

DETAILED DESCRIPTION

Figure 1:
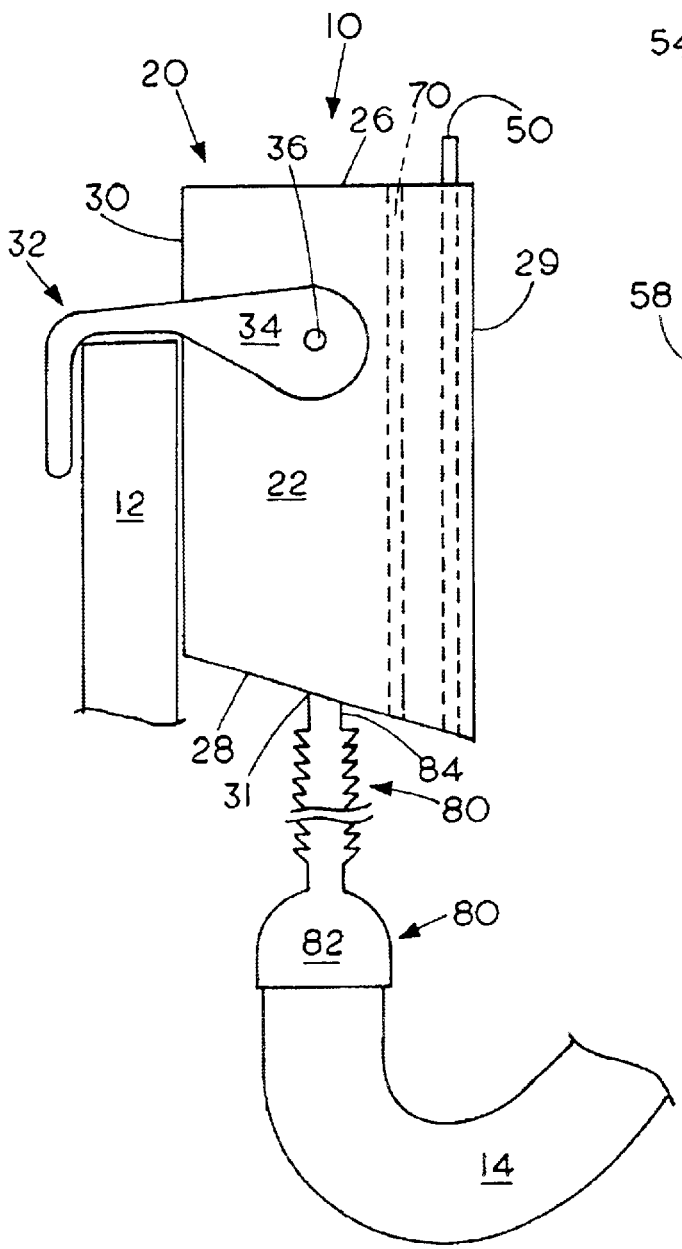
FIG. 1 is a side view of the present invention shown mounted on a utility sink and joined to a washing machine hose.
Figure 2:
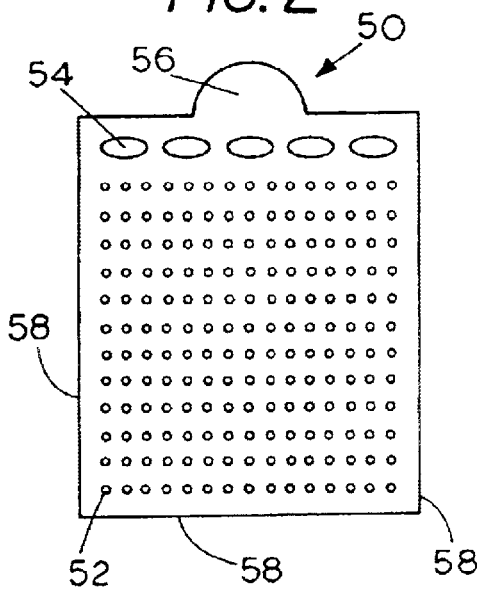
FIG. 2 is a front view of the lint collection plate.
Figure 3:
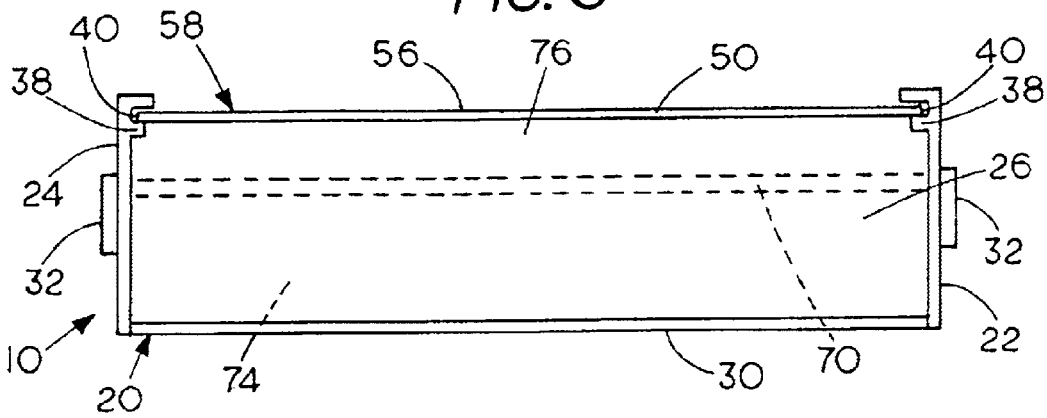
FIG. 3 is a top view of the present invention with the chamber divider wall shown in cross section.
Figure 4:
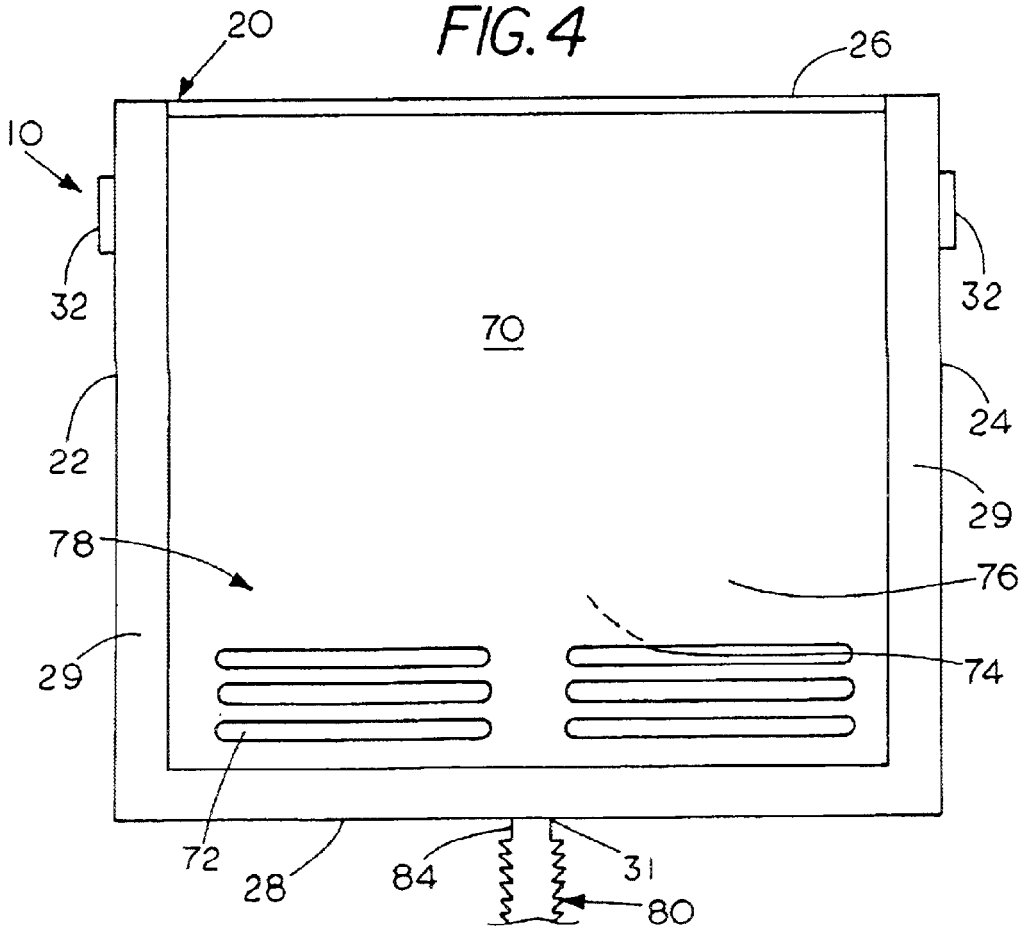
FIG. 4 is a front view of the present invention with the lint collection plate removed.
Figure 5:
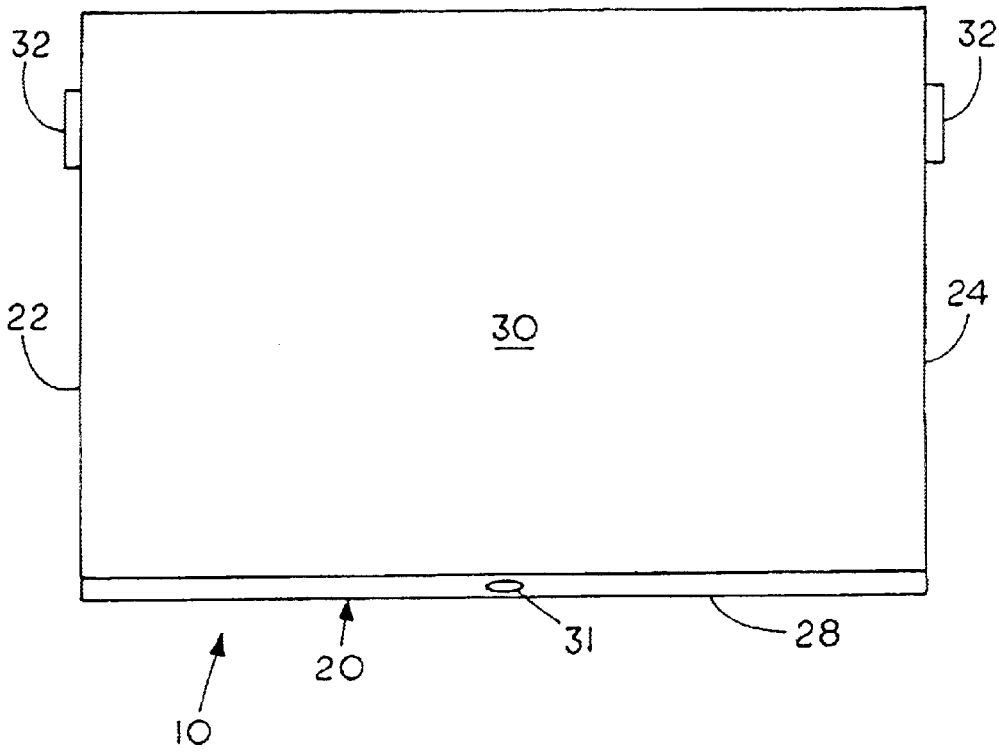
FIG. 5 is a back view of the present invention.
Figure 6:
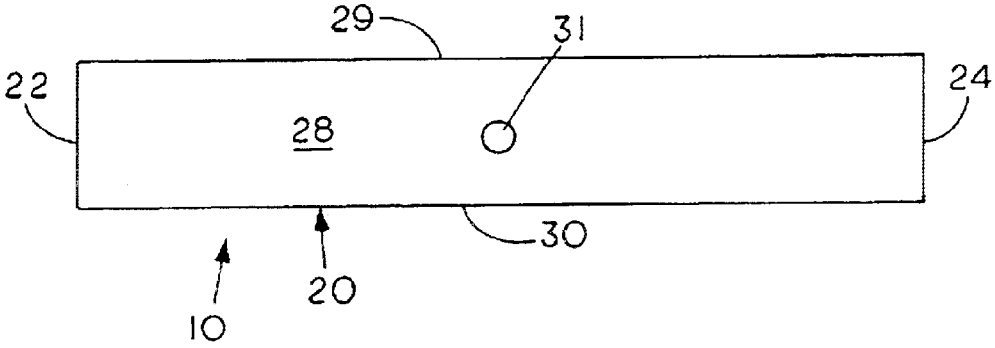
FIG. 6 is a bottom view of the present invention.

The lint trap 10 of the present invention is provided with a housing 20, a lint collection plate 50, a chamber divider wall 70 and an adapter 80. The chamber divider wall 70 may permanently separate the interior of the housing 20 into two chambers (described below). The lint collection plate 50 is removably received within the housing 20. The adapter 80 may communicate water from a washing machine hose 14 to the housing 20. Each of these components will be discussed in further detail below.

The housing 20 may have a first side wall 22, a second side wall 24, a top wall 26, a bottom wall 28, a front wall 29 and back wall 30. The bottom wall 28 may define an aperture 31. The bottom wall 28 preferably is positioned off horizontal, e.g., slanted, to cause water to move from adjacent the back wall 30 toward the front wall 29. The front wall 30 preferably is U-shaped as shown in the drawing, which is covered by the lint collection plate 50, when inserted.

At least one attachment mechanism 32 may be pivotally secured to at least one side wall 22,24. Preferably, one attachment mechanism 32 is attached to each side wall 22,24. Attachment mechanism 32 may include a hook 34 adapted to selectively join to a utility sink 12 as shown in FIG. 1. A pivot 36 allows the hooks 34 to be rotated adjacent the associated side wall 22,24 when not in use.

Projections 38 may be joined to the side walls 22,24 on the inside of the housing such that the projections 38 and the front wall 29 cooperatively defining a lint collection plate slot 40. Such projections 38 do not need to be any particular size or shape, but rather to provide support to one side of the lint collection plate 50, while the front wall 29 provides support to the opposite side of the lint collection plate 50. Desirably, only the perimeter 58 of the lint collection plate 50 is positioned within the lint collection plate slot 40.

Lint collection plate 50 preferably defines flow apertures 52 sized, numbered and positioned to collect lint from water flowing therethrough. Lint collection plate 50 may further define overflow apertures 54, positioned above flow apertures 52, to allow water to release from the housing in the case where the flow apertures 52 become plugged with lint. The overflow apertures 54 may be sized large enough so as to avoid capture of lint and plugging of the overflow apertures 54. A handle 56 may be designed into the lint collection plate 50 for removal of the plate 50 from the housing, when removal of lint from the plate 50 is desired. The perimeter 58 of the lint collection plate 50 is sized and shaped to be removably received within the lint collection plate slot 40.

Chamber divider wall 70 may be sealably secured between the first and second side walls 22,24 and the top and bottom walls 26,27 of the housing 20. The chamber divider wall 70 defining a flow rate control chamber 74 and a water release chamber 76 inside the housing 20. Apertures 72 may be defined through the chamber divider wall 70 on a lower portion 78 thereof. The apertures 74 are adapted to allow water to flow through the chamber divider wall 70 from the flow rate control chamber 74 to the water release chamber 76.

The adapter 80 preferably has a hose end 82 and a trap end 84. The hose end 82 may be adapted to join to a washing machine hose of a variety of sizes via clamps, friction fit, stretch fit or other manner known in the trade of joining two hoses. The connection should be leak proof and may be permanent or removable. The trap end 84 may be joined relative to the aperture 31 defined in the bottom wall 28 of the housing 20.

A method of removing lint from a washing machine discharge, may include the steps of flowing water into a flow rate control chamber of a lint trap; flowing water from the flow rate control chamber to a water release chamber; flowing water from the water release chamber through a lint collection plate; removing the lint collection plate from the lint trap; wiping the lint off the lint collection plate; and reconnecting the lint collection plate to the lint trap.

The adapter 80 may direct the water from the washing machine hose 14 through the bottom wall 28, projecting the water upward. The water loses its speed to increase the ability of the trap 10 to collect the lint, by directing the water upward away from the apertures 72 in the chamber divider wall 70. Gravity slows the water, reverses its direction onto or into itself and returns it adjacent the bottom wall 28 where the water may then flow through the chamber divider wall 70 and into the water release chamber 76. The water then flows at a much reduced rate through the flow apertures 52 defined in the lint collection plate 50. The lint collects on the plate 50. Such plate 50 may be removed to wipe the lint from the plate 50. Once clean, the plate 50 may be re-inserted into the housing 20 and reused.

Although the present invention has been described with reference to preferred embodiments, workers skilled in the art will recognize changes may be made in form and detail without departing from the spirit and scope of the invention.

What is claimed is:

1. A lint trap, comprising:

a housing having a first side wall, a second side wall, a top wall, a bottom wall, a back wall and a front wall, the bottom wall defining an aperture and the bottom wall being off horizontal;

at least one attachment mechanism pivotally secured to at least one side wall, the attachment mechanism including a hook adapted to selectively join to a utility sink;

projections joined to the side walls, the projections and the front wall cooperative defining a lint collection plate slot;

a lint collection plate defining flow apertures and overflow apertures, the lint collection plate having a handle and a perimeter, the perimeter of the lint collection plate being slidably received within the lint collection plate slot;

a chamber divider wall secured between the first and second side walls and the top and bottom walls, the chamber divider wall defining a flow rate control chamber and a water release chamber, and the chamber divider wall defining apertures adapted to allow water to flow through the chamber divider wall from the flow rate control chamber to the water release chamber; and an adapter having a hose end and a trap end, the hose end being adapted to join to a hose of a washing machine and the trap end being joined relative to the aperture defined in the bottom wall.

2. A lint trap, comprising:

a housing having a first side wall, a second side wall, a top wall, a bottom wall, a back wall and a front wall, and the bottom wall defining an aperture;

at least one attachment mechanism joining the housing to a utility sink;

a lint collection plate slot defined in the side walls;

a lint collection plate, the lint collection plate being slidably received within the lint collection plate slot; and an adapter having a hose end and a trap end, the hose end being adapted to join to a hose of a washing machine and the trap end being joined relative to the aperture defined in the bottom wall.

3. The device of claim 2 wherein the bottom wall is off horizontal.

4. The device of claim 3 wherein the attachment mechanism is pivotally secured to at least one side wall.

5. The device of claim 3 wherein the attachment mechanism includes a hook adapted to selectively join to a utility sink.

6. The device of claim 3 further comprising projections joined to the side walls.

7. The device of claim 6 wherein the projections and the front wall cooperative defining the lint collection plate slot.

8. The device of claim 2 wherein the lint collection plate defines flow apertures and overflow apertures.

9. The device of claim 2 wherein the lint collection plate has a handle and a perimeter, the perimeter of the lint collection plate being slidably received within the lint collection plate slot.

10. The device of claim 2 further comprising a chamber divider wall secured between the first and second side walls and the top and bottom walls, the chamber divider wall defining a flow rate control chamber and a water release chamber.

11. The device of claim 10 wherein the chamber divider wall defines apertures adapted to allow water to flow through the chamber divider wall from the flow rate control chamber to the water release chamber.

12. The device of claim 11 wherein the chamber divider apertures are disposed adjacent a lower edge of the chamber divider wall.

13. The device of claim 11 wherein the chamber divider apertures are sufficiently large so as to generally allow passage of lint therethrough.

14. The device of claim 10 wherein the water release chamber is upstream from the lint collection plate.

15. The device of claim 2 wherein the lint collection plate is removable and reusable.

16. The device of claim 2 wherein the lint collection plate defines lint collection apertures, the lint collection apertures sufficiently small so as to generally prevent passage of lint therethrough while being sufficiently large to allow the passage of water therethrough.

17. The device of claim 2 wherein the overflow apertures are sufficiently large to generally allow passage of lint therethrough.

* * * * *